United States Patent [19]

Sinkes

[11] 4,359,850

[45] Nov. 23, 1982

[54] BRICK CONTROL DEVICE AND METHOD

[76] Inventor: Donald W. Sinkes, R.R. 6, North Vernon, Ind. 47265

[21] Appl. No.: 150,337

[22] Filed: May 16, 1980

[51] Int. Cl.[3] ..... E04D 15/00

[52] U.S. Cl. ..... 52/747; 52/749; 33/406

[58] Field of Search ..... 52/747, 749; 33/404, 33/405, 406, 407, 408, 409, 410

[56] References Cited

U.S. PATENT DOCUMENTS

| | | | |
|---|---|---|---|
| 1,878,448 | 9/1932 | Cornuelle . | |
| 3,063,152 | 11/1962 | Colbert | 33/406 |
| 3,127,683 | 4/1964 | Garton et al. | 33/85 |
| 3,130,500 | 4/1964 | Bongiovanni | 33/406 |
| 3,206,854 | 9/1965 | Andrews | 33/406 |
| 3,397,458 | 8/1968 | Wicklund . | |
| 4,074,503 | 2/1978 | Watt et al. | 52/749 |
| 4,144,649 | 3/1979 | Huston | 33/85 |

*Primary Examiner*—Price C. Faw, Jr.
*Assistant Examiner*—Carl D. Friedman
*Attorney, Agent, or Firm*—Woodard, Weikart, Emhardt & Naughton

[57] ABSTRACT

A brick control device including a base portion attachable to a wall, a brick flange extending outwardly therefrom for providing vertical alignment of the edge of the brick facing, and a portion extending from the base and including a string flange for attachment of a string holder. Also disclosed herein is a method utilizing a pair of opposed brick control devices with an alignment string spanning therebetween to provide a brick facing which is horizontally and vertically aligned.

6 Claims, 2 Drawing Figures

BRICK CONTROL DEVICE AND METHOD

BACKGROUND OF THE INVENTION

1. Field of the Invention

The present invention relates to a brick laying accessory, and particularly to a device for providing controlled vertical and horizontal alignment of bricks in a brick facing.

2. DESCRIPTION OF THE PRIOR ART

A variety of accessories for the brick mason have been provided in the prior art. Many of these have related to means for assuring alignment of the bricks either in the vertical or horizontal directions. Many of these have also been provided for specific or special instances of brick laying. The present invention provides a device and method which assures vertical and horizontal alignment of the bricks with a minimum of time and effort on the part of the brick mason.

In U.S. Pat. No. 4,144,649, issued to Huston on Mar. 20, 1979, there is disclosed a brick alignment pole which is designed for aligning courses of brick in a brick wall. The Huston pole includes an arm adjustably attached to a rectangular pole for mounting the pole to a wall. The Huston pole is not designed, however, to provide vertical alignment of the edge of the wall as described herein. A brick layer's leveling and plumbing device is disclosed in U.S. Pat. No. 1,878,448, issue to Cornuelle on Sept. 20, 1932. The Cornuelle device comprises an upright support composed of a metal formed in the shape of a hollow square and including vertical guides. The device also includes ledge portions for seating on the top surface of a course of bricks as well as slotted portions for the reception of a chalk line. Other devices for assisting in the laying of bricks are disclosed in U.S. Pat. Nos. 4,074,503, issued to Watt et al. on Feb. 21, 1978; 3,397,458, issued on Wicklund on Aug. 20, 1968; and 3,127,683, issued to Garton et al. on Apr. 7, 1964. In contrast to these devices, the present invention provides a brick control device which is easily mounted by direct attachment to a stud wall, and which provides for alignment of the vertical edges of the wall as well as the horizontal alignment of the brick courses and the vertical alignment of the brick face.

SUMMARY OF THE INVENTION

In one aspect the present invention provides a brick control device which includes a base portion mountable to a wall, a brick flange extending therefrom to provide vertical alignment of the edge of the brick facing, and a string flange extending from the base portion for securement of an alignment string thereto. The present invention also provides a method for laying a brick facing with a device of the described type.

It is an object of the present invention to provide a brick control device which is easily and simply constructed, and which is simple in use.

It is a further object of the present invention to provide a brick control device which is readily installed for use, and which is installed in a manner that will not be detectable after it is removed.

It is a further object of the present invention to provide a brick control device which is inexpensive to construct, and which is reusable.

Another object of the present invention is to provide a brick control device which is operable to assure vertical alignment of the edge of the brick wall, horizontal alignment of the courses of brick, and vertical alignment of the faces of the brick.

It is another object of the present invention to provide a method for laying a brick facing which is simple and quick, and which assures alignment of the vertical and horizontal aspects of the facing.

Further objects and advantages of the present invention will become apparent from the description of the preferred embodiment which follows.

DESCRIPTION OF THE PREFERRED EMBODIMENT

Figure 1:
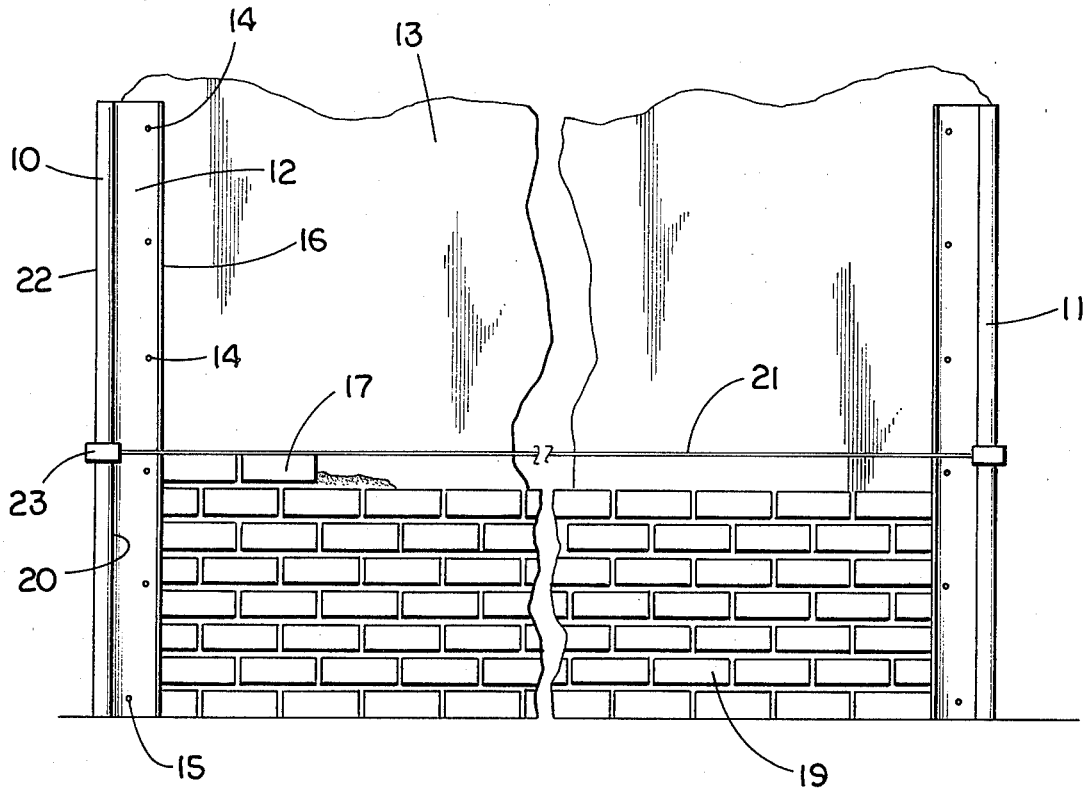
FIG. 1 is a front, elevational view of brick control devices of the present invention shown in use for installing a brick facing on a stud wall.
Figure 2:
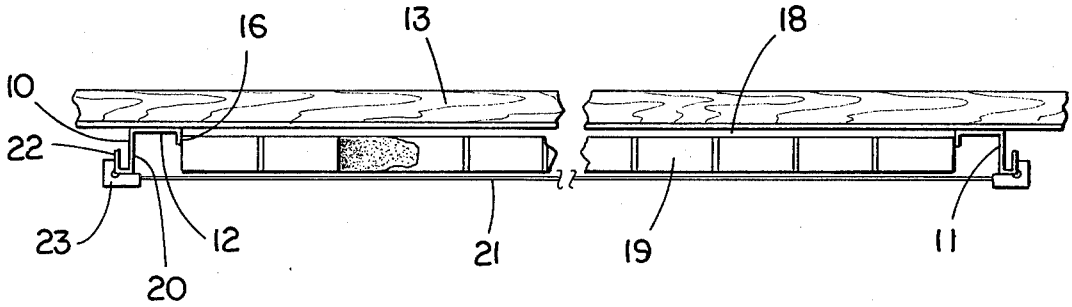
FIG. 2 is a top, plan view of the arrangement of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to the drawings, there are shown brick control devices 10 and 11 constructed in accordance with the present invention. Devices 10 and 11 are preferably identical with the exception that they are mirror images of one another, and therefore only the structure of device 10 will be described in detail.

Device 10 includes a base portion 12 which is secured to the wall 13. Wall 13 will typically be a stud wall, and the preferred method of securement is by nailing or similar means through the upper attachment holes 14 and the lower attachment hole 15. It will be noted that the upper attachment holes 14 are located in proximity to the brick flange 16. In this manner, the holes which are caused by the attachment of the device to the wall will be covered by the usual corner molding which will thereafter be secured to the wall adjacent the bricks. The lower attachment point 15 may be spaced apart from the brick flange 16 since the usual baseboard molding will extend adjacent the corner molding at this location and will cover up any hole in the wall made by securement at this point.

Brick flange 16 extends perpendicular to the base portion 12. Brick flange 16 provides an end stop for the bricks 17, thereby assuring a straight and uniform outside edge for the brick wall. Brick flange 16 may extend out to the extent necessary, and typically should extend out a distance greater than the desired air space 18 between the brick wall 19 and the stud wall 13. The air space is desirable as a means of insulating the stud wall from the brick wall, particularly where the brick wall is used as a facing for a fireplace or as a brick facing behind a woodburning stove or similar device.

Also extending outwardly from the base portion 12 is a portion 20 to which the string 21 is attached for use in the usual manner. The string 21 provides a horizontal alignment of the bricks 17 for each course of brick. The string also provides for a uniform spacing of the bricks from the wall 13, and therefore provides a uniform, flat front surface to the facing. Portion 20 preferably includes a string flange 22 for securement of the alignment string thereto. The string flange may have a variety of shapes, but is preferably shaped and oriented to accommodate a string holder 23 which may be moved up and down along this flange.

As will be seen from the present description, the brick control devices of the present invention provide for a quick and simple method for laying a brick facing wall of high quality. The devices are easily and quickly installed on a stud wall or similar wall by attachment at the locations 14 and 15. The devices include a brick flange 16 which defines the outer vertical edge for the brick facing, and also a string flange 22 which is spaced an even distance from the stud wall and is adapted to receive a string and string holder. The string holder may be adapted for being adjusted to various locations along the string flange to provide for a ready change in the location of the guide string as the successive courses of brick are laid. After the facing has been completed, the brick control devices 10 and 11 are quickly removed from the walls and the points of attachment are hidden by the baseboard and corner moldings provided adjacent the facing.

Various alterations within the scope of the present invention are contemplated. For example, the sizes of the brick flange 16 and the string flange 22 and portion 20 may be varied to accommodate various sizes or styles of bricks. The brick control devices may be constructed in different lengths, with a preferred form being steel units which are 7'11¼" length, and which would then weigh about 17 pounds. As a further alteration, the string flanges 22 may include scales to correspond with differing sizes of bricks to facilitate movement of the string to align the successive courses of brick. These string flanges 22 may also be provided in differing shapes to accommodate any string holder of a particular design. In addition, it will be seen that the providing of additional attachment locations would permit the control devices 10 and 11 to be interchangeable simply by inverting them and placing them on the other sides of the wall.

The present invention provides a brick control device and method which is particularly suited for the laying of decorative brick facings, typically along interior walls. Common uses for such facings are the facings on a fireplace or the facing behind a woodburning stove or similar device. The present invention provides the brick mason with a means to accurately control the vertical outside edges of the brick facing, as well as the horizontal alignment of the courses of brick and the vertical alignment of the front surfaces of the bricks. As a result, a brick facing of high quality and accuracy may be achieved with reduced time and effort.

What is claimed is:

1. A brick control device for laying a brick facing adjacent a wall, which comprises:

an elongated base portion having first and second longitudinal edges;

mounting means for mounting said base portion to the wall;

a brick flange integral with and extending outwardly from the first longitudinal edge of said base portion, said mounting means being for mounting said base portion to have said brick flange positioned to have the bricks at the outer vertical edge of the brick facing abut with said brick flange to act as an end stop for the bricks and to define the outer vertical edge of the brick facing;

a string support portion integral with and extending outwardly from the second longitudinal edge of said base portion on the same side as said brick flange;

an alignment string; and attachment means for attaching said string to said string support portion at different locations along said string support portion.

2. The brick control device of claim 1 in which said string support portion includes an integral string flange, said attachment means being for attaching said string to said string flange.

3. The brick control device of claim 2 in which said brick flange and said string support portion extend perpendicularly from said base portion and in which said string flange extends perpendicularly from said string support portion in a direction away from said brick flange.

4. The brick control device of claim 3 in which said mounting means includes holes in said base portion adjacent said brick flange.

5. The brick control device of claim 1 and which further includes a string holder mountable to said string support portion, said alignment string being secured to said string holder.

6. A method for laying a brick facing adjacent a wall which comprises the steps of:

(a) mounting first and second brick control devices to the wall, each of said brick control devices including an elongated base portion having first and second longitudinal edges, a brick flange integral with and extending outwardly from the first longitudinal edge of the base portion, and a string support portion integral with and extending outwardly from the second longitudinal edge of the base portion on the same side as the brick flange, the first and second brick control devices being mounted with the brick flanges directed inwardly;

securing an alignment string to the string support portions of the first and second brick control devices to span therebetween; and laying courses of brick with the outside edges of the brick resting adjacent the brick flanges of the first and second brick control devices and further using the alignment string to align the bricks horizontally and vertically.

* * * * *